US012679612B2

(12) United States Patent
Ulogo

(10) Patent No.: US 12,679,612 B2
(45) Date of Patent: Jul. 14, 2026

(54) SEALABLE GIFT WRAPPING DEVICE

(71) Applicant: Chuckwudi Ulogo, Chicago, IL (US)

(72) Inventor: Chuckwudi Ulogo, Chicago, IL (US)

( * ) Notice: Subject to any disclaimer, the term of this patent is extended or adjusted under 35 U.S.C. 154(b) by 154 days.

(21) Appl. No.: 18/376,264

(22) Filed: Oct. 3, 2023

(65) Prior Publication Data

US 2025/0108967 A1 Apr. 3, 2025

(51) Int. Cl.
*B65D 65/10* (2006.01)
*B65D 65/22* (2006.01)

(52) U.S. Cl.
CPC ..... *B65D 65/22* (2013.01); *B65D 65/10* (2013.01)

(58) Field of Classification Search
CPC ..... B65D 65/10; B65D 65/12; B65D 65/14; B65D 65/22; B65D 65/02; B65D 65/24
USPC ... 229/87.18, 87.19, 87.05, 922, 923, 116.5; 206/457; 383/2
See application file for complete search history.

(56) References Cited

U.S. PATENT DOCUMENTS 3,489,333 A * 1/1970 Gale ..... B65D 75/20 229/117.07
3,944,131 A * 3/1976 Weiss ..... B65D 5/02 206/424
5,094,385 A * 3/1992 Antczak ..... B65D 5/4279 229/110
6,085,904 A * 7/2000 Perdue, Jr. ..... B65D 75/5833 229/87.05
6,220,505 B1 * 4/2001 Flynn ..... G11B 33/0494 206/312
6,495,228 B1 * 12/2002 Mauch ..... B65D 65/14 229/87.01
6,699,541 B2 * 3/2004 Finestone ..... B32B 27/08 428/34.3
7,077,308 B2 7/2006 Beach
8,387,346 B1 3/2013 Coates
8,931,242 B1 1/2015 Sardo
D743,807 S 11/2015 First
9,902,540 B2 2/2018 Hoffman
11,008,128 B2 * 5/2021 Kuranda ..... B65C 9/0015
2003/0077422 A1 * 4/2003 Riddick ..... B65D 5/0005 428/156
2007/0046441 A1 3/2007 McCormick
2008/0093427 A1 * 4/2008 Kuranda ..... B65B 11/48 229/87.05
2009/0127322 A1 5/2009 Miller
(Continued)

FOREIGN PATENT DOCUMENTS

WO WO2016135580 9/2016

*Primary Examiner* — Nathan J Newhouse
*Assistant Examiner* — Nina K Attel

(57) ABSTRACT

A sealable gift wrapping device includes a panel that has a pair of curves each formed into the panel to define a spine portion and a top portion and a bottom portion of the panel. A plurality of first couplers is attached to the top portion of the panel and a plurality of second couplers is attached to the bottom portion of the panel. Each of the second couplers is matable to a respective one of the plurality of first couplers to enclose a gift in the panel in the convention of gift wrapping. A plurality of third couplers is attached to the top portion of the panel and a plurality of fourth couplers is attached to the bottom portion of the panel. Each of the plurality of fourth couplers is matable to a respective one of the plurality to third couplers.

8 Claims, 5 Drawing Sheets

(56) References Cited

U.S. PATENT DOCUMENTS

| | | | | |
|---|---|---|---|---|
| 2015/0307247 | A1* | 10/2015 | Root | B65D 65/14 229/87.01 |
| 2016/0016710 | A1* | 1/2016 | Merrill | B65B 67/08 229/87.01 |
| 2017/0305621 | A1 | 10/2017 | Miller | |
| 2022/0073245 | A1 | 3/2022 | Downey | |

* cited by examiner

SEALABLE GIFT WRAPPING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wrapping devices and more particularly pertains to a new wrapping device for wrapping a gift without employing adhesive tape or scissors. The device includes a panel which has a pair of curves defining a spine portion and a top portion and a bottom portion of the panel. A plurality of first couplers and second couplers are attached to the panel which are matable together to wrap the panel around a gift. Furthermore, the panel has a plurality of perforations defining strips that can be removed from the panel to shrink the width of the panel to match the wide of the gift.

(2) Description of Related Art Including Information Disclosed Under 37 CFR 1.97 and 1.98

The prior art relates to wrapping devices including a variety of gift wrapping devices that includes a variety of films for wrapping a gift and a variety of reusable pouches to wrapping a gift and variety of films that have pre-applied adhesive tape and bow ties. In no instance does the prior art disclose a gift wrapping device that includes a panel formed to partially surround a gift which has perforations defining strips that are removable from the panel to adjust a width of the panel and a plurality of first couplers and a plurality of second couplers each attached to the panel which are matable to each other for enclosing the gift in the panel.

BRIEF SUMMARY OF THE INVENTION

An embodiment of the disclosure meets the needs presented above by generally comprising a panel that has a pair of curves each formed into the panel to define a spine portion and a top portion and a bottom portion of the panel. A plurality of first couplers is attached to the top portion of the panel and a plurality of second couplers is attached to the bottom portion of the panel. Each of the second couplers is matable to a respective one of the plurality of first couplers to enclose a gift in the panel in the convention of gift wrapping. A plurality of third couplers is attached to the top portion of the panel and a plurality of fourth couplers is attached to the bottom portion of the panel. Each of the plurality of fourth couplers is matable to a respective one of the plurality to third couplers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
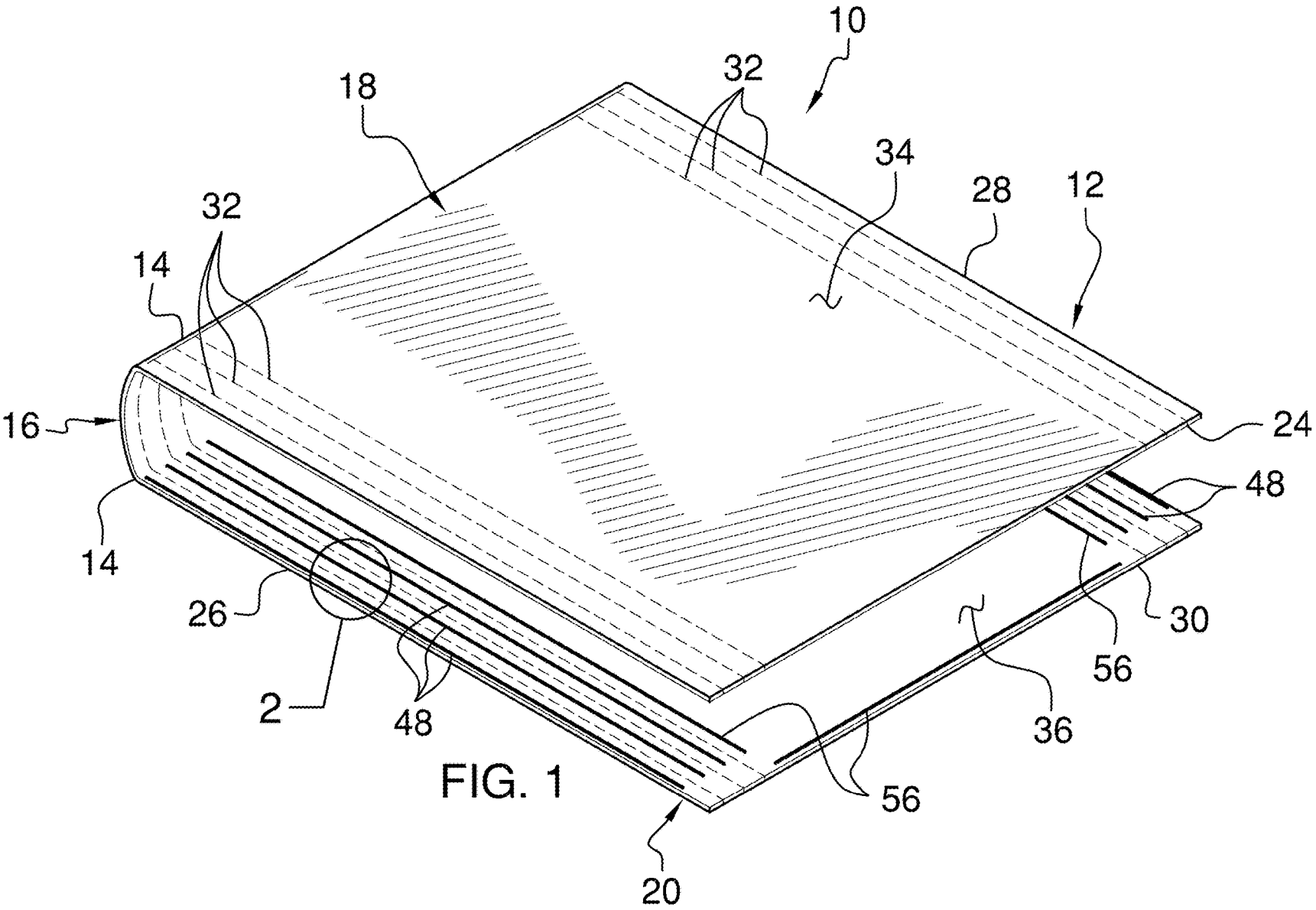
FIG. 1 is a top perspective view of a sealable gift wrapping device according to an embodiment of the disclosure.
Figure 2:
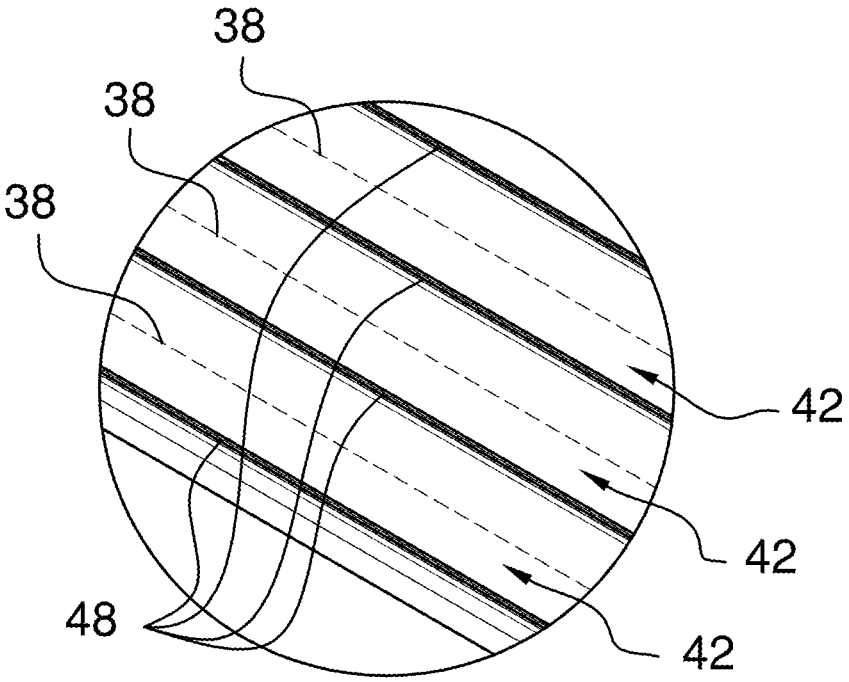
FIG. 2 is a magnified detail view taken from circle 2 of FIG. 1 of an embodiment of the disclosure.
Figure 3:
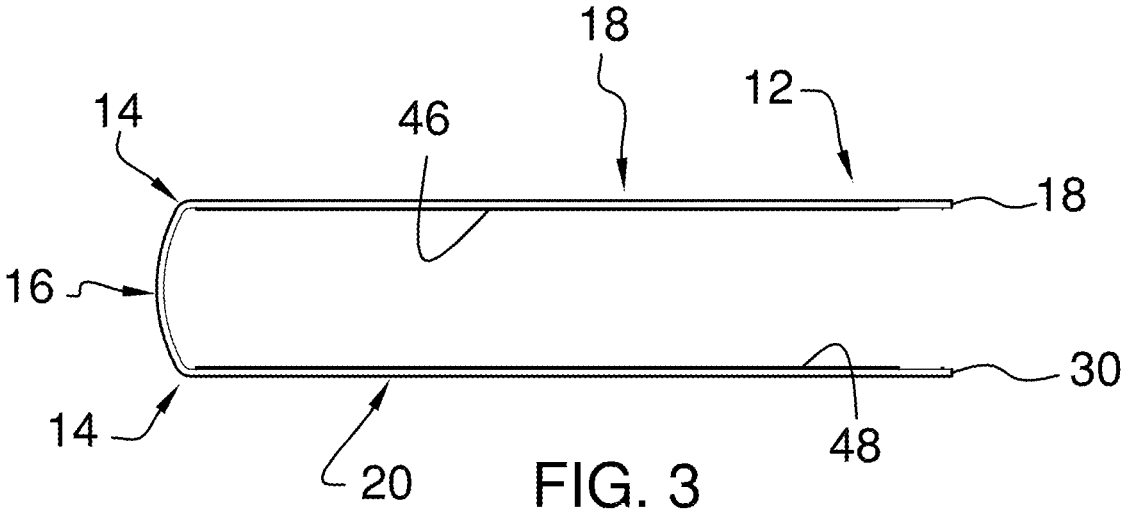
FIG. 3 is a right side view of an embodiment of the disclosure.
Figure 4:
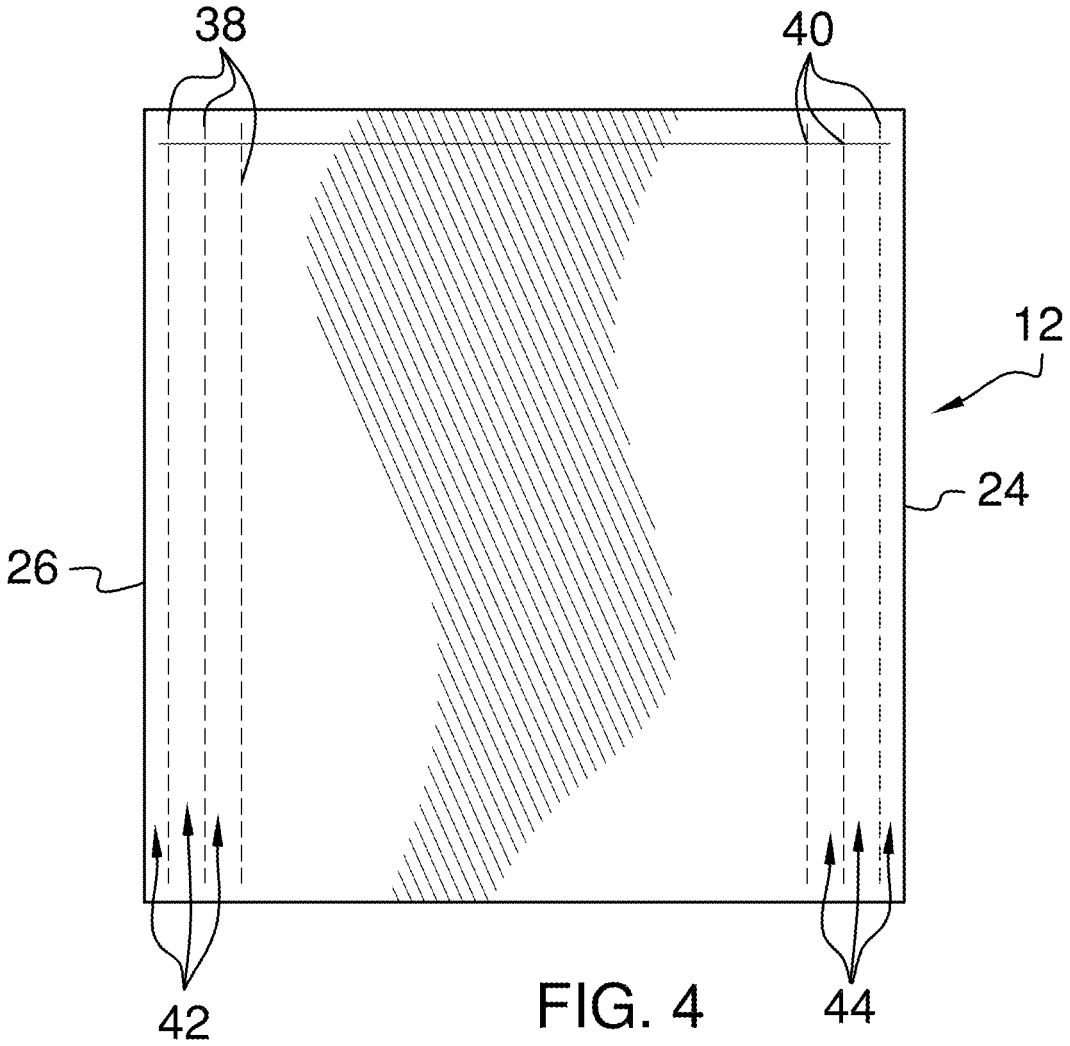
FIG. 4 is a top view of an embodiment of the disclosure.
Figure 5:
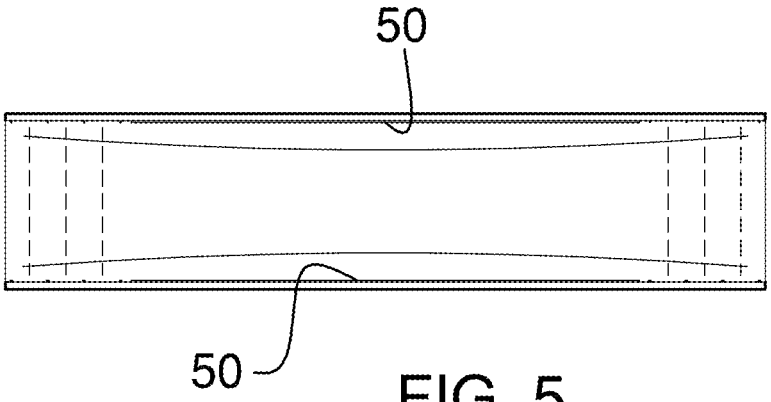
FIG. 5 is a front view of an embodiment of the disclosure.
Figure 6:
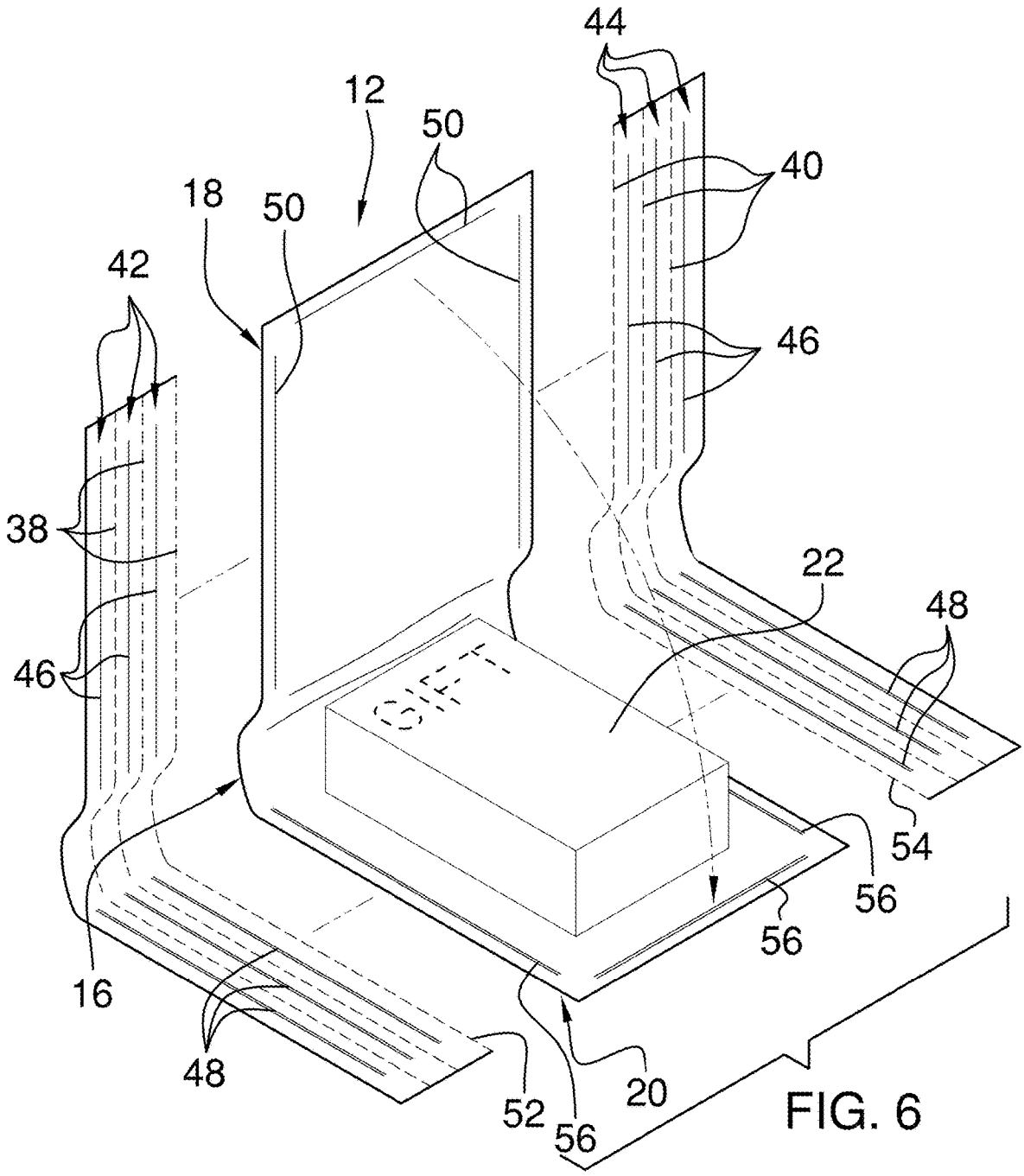
FIG. 6 is an exploded perspective view of an embodiment of the disclosure showing first strips and second strips being removed from a panel to adjust a width of the panel.
Figure 7:
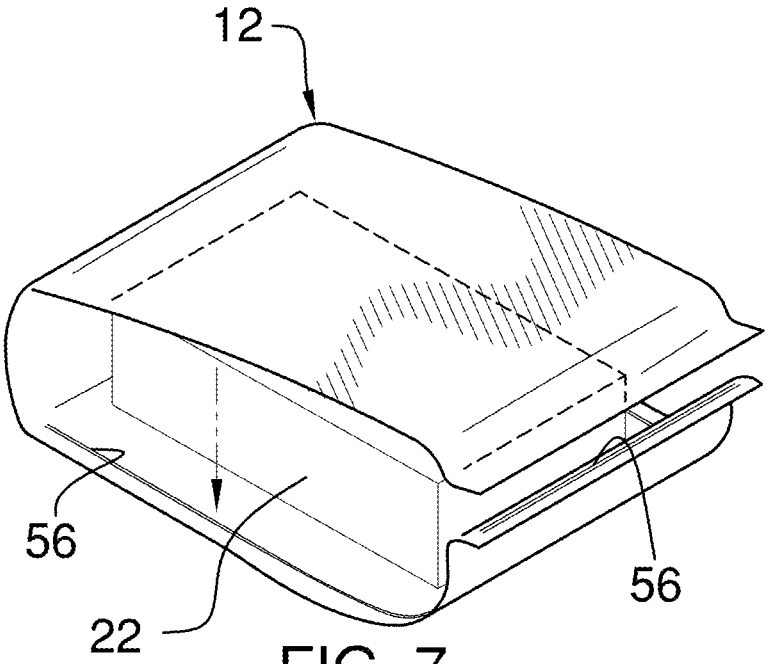
FIG. 7 is a perspective in-use view of an embodiment of the disclosure showing a panel being wrapped around a gift.
Figure 8:
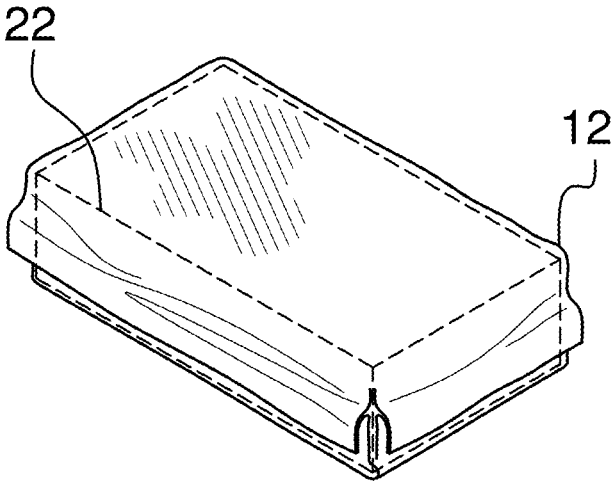
FIG. 8 is a perspective in-use view of an embodiment of the disclosure showing a gift being enclosed in a panel.

With reference now to the drawings, and in particular to FIGS. 1 through 8 thereof, a new wrapping device embodying the principles and concepts of an embodiment of the disclosure and generally designated by the reference numeral 10 will be described.

As best illustrated in FIGS. 1 through 8, the sealable gift wrapping device 10 generally comprises a panel 12 that has a pair of curves 14 each being formed into the panel 12 which are each oriented parallel to each other to define a spine portion 16 of the panel 12 extending between a top portion 18 and a bottom portion 20 of the panel 12. In this way the panel 12 can be positioned around a gift 22 having the gift 22 lying on the bottom portion 20 and having the top portion 18 lying on the gift 22. The gift 22 may be stored in a box that has a cuboid shape or the like. The panel 12 has a first lateral edge 24, a second lateral edge 26, a front edge 28 and a back edge 30 and each of the curves 14 extends between the first lateral edge 24 and the second lateral edge 26. Additionally, each of the curves 14 is positioned on opposite sides of a centerline of the panel 12 such that the spine portion 16 is defined between the pair of curves 14. The bottom portion 20 is associated with the back edge 30 and the top portion 18 is associated with the front edge 28.

The panel 12 has a plurality of perforations 32 extending through a top surface 34 and a bottom surface 36 of the panel 12 and the perforations 32 are oriented to extend between the front edge 28 and the back edge 30 of the panel 12. Furthermore, the plurality of perforation includes a set of first perforations 38 and a set of second perforations 40. The set of first perforations 38 are evenly spaced apart from each other and are distributed from the first lateral edge 24 toward the second lateral edge 26 to define a plurality of first strips 42 of the panel 12. Additionally, the set of second perforations 40 are evenly spaced apart from each other and are distributed from the second lateral edge 26 toward the first lateral edge 24 to define a plurality of second strips 44 of the panel 12. Respective ones of the first strips 42 and respective ones of the second strips 44 are removable from the panel 12 such that the panel 12 can be reduced in size to match a width of the gift 22.

A plurality of first couplers 46 is provided and each of the plurality of first couplers 46 is attached to the panel 12. Each of the plurality of first couplers 46 is positioned on the bottom surface 36 of the top portion 18 of the panel 12 and each of the plurality of first couplers 46 is oriented to extend along a line extending between the front edge 28 and the back edge 30 of the panel 12. Additionally, each of the plurality of first couplers 46 is positioned on a respective of the first strips 42 or a respective one of the second strips 44. Each of the first couplers 46 may comprise a female portion of a zip fastener or the like.

A plurality of second couplers 48 is provided and each of the plurality of second couplers 48 is attached to the panel 12. Each of the plurality of second couplers 48 is positioned on the bottom surface 36 of the bottom portion 20 of the panel 12 and each of the plurality of second couplers 48 is oriented to extend along a line which extends between the front edge 28 and the back edge 30 of the panel 12. Each of the plurality of second couplers 48 is positioned on a respective of the first strips 42 or a respective one of the second strips 44. Furthermore, each of the plurality of second couplers 48 is aligned with a respective one of the plurality of first couplers 46.

Each of the second couplers 48 which remain on the panel 12 when the respective first strips 42 or second strips 44 are removed from the panel 12 is matable to the respective first coupler 46 which remains on the panel 12 when the respective first strips 42 or second strips 44 are removed from the panel 12. In this way the first couplers 46 and the second couplers 48 facilitate the packet to enclose the gift 22 in the convention of gift wrapping. Additionally, each of the plurality of second couplers 48 may comprise a male portion of a zip fastener or the like.

A plurality of third couplers 50 is provided and each of the plurality of third couplers 50 is attached to the panel 12. Each of the plurality of third couplers 50 is positioned on the bottom surface 36 of the top portion 18 of the panel 12 and respective ones of the plurality of third couplers 50 is positioned adjacent to a respective one of an innermost first perforation 52 and an innermost second perforation 54. Furthermore, a respective one of the plurality of third couplers 50 is positioned adjacent to the front edge 28. Each of the plurality of third couplers 50 may comprise a female portion of a zip fastener or the like.

A plurality of fourth couplers 56 is provided and each of the plurality of fourth couplers 56 is attached to the panel 12. Each of the plurality of fourth couplers 56 is positioned on the bottom surface 36 of the bottom portion 20 of the panel 12 and respective ones of the plurality of fourth couplers 56 is positioned adjacent to a respective one of the innermost first perforation 52 and the innermost second perforation 54. A respective one of the plurality of fourth couplers 56 is positioned adjacent to the back edge 30 and each of the plurality of fourth couplers 56 is aligned with a respective one of the plurality of third couplers 50. Additionally, each of the plurality of fourth couplers 56 is matable to the respective third coupler 50 when all of the first strips 42 and all of the second strips 44 have been removed from the panel 12. In this way the plurality of third couplers 50 and the plurality of fourth couplers 56 facilitate the panel 12 to enclose the gift 22 in the convenient of gift wrapping. Each of the plurality of fourth couplers 56 may comprise a male portion of a zip fastener or the like.

In use, the gift 22 is positioned on the bottom portion 20 of the panel 12 such that the gift 22 abuts the spine portion 16 of the panel 12 and the top portion 18 of the panel 12 lies on top of the gift 22. As many of the first strips 42 and the second strips 44 are removed from the panel 12 as needed to facilitate the panel 12 to match the width of the gift 22. An outermost one of the first couplers 46 is mated to an outermost one of the second couplers 48 and the third coupler 50 which extends along the front edge 28 of the panel 12 is mated to the fourth coupler 56 which extends along the back edge 30 of the panel 12. In this way the gift 22 can be wrapped without the use of adhesive tape and scissors. The third coupler 60 positioned adjacent to the innermost first perforation 52 is mated to the fourth coupler 56 positioned adjacent to the innermost first perforation 52 and the third coupler 60 positioned adjacent to the innermost second perforation 54 is mated to the fourth coupler 56 positioned adjacent to the innermost second perforation 54 when all of the first strips 42 and second strips 44 have been removed.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sealable gift wrapping device to facilitate wrapping a gift without the use of scissors or tape, said device comprising:

a panel having a pair of curves each being formed into said panel which are each oriented parallel to each other to define a spine portion of said panel extending between a top portion and a bottom portion of said panel wherein said panel is configured to be positioned around a gift having a lower surface of the gift lying on said bottom portion and having said top portion lying on an upper surface of the gift, said panel having a first lateral edge and a second lateral edge, said panel having a plurality of perforations extending through a top surface and a bottom surface of said panel, said plurality of perforation including a set of first perforations and a set of second perforations, said set of first perforations being distributed from said first lateral edge toward said second lateral edge to define a plurality of first strips of said panel, said set of second perforations being distributed from said second lateral edge toward said first lateral edge to define a plurality of second strips of said panel, respective ones of said plurality of first strips and respective ones of said plurality of second strips being removable from said panel wherein said panel is configured to be reduced in size to match a width of the gift;

a plurality of first couplers, each of said plurality of first couplers being attached to said panel, each of said plurality of first couplers being positioned on said top portion of said panel;

a plurality of second couplers, each of said plurality of second couplers being attached to said panel, each of said plurality of second couplers being positioned on said bottom portion of said panel, each of said plurality of second couplers being matable to a respective one of said plurality of first couplers wherein said plurality of first couplers and said plurality of second couplers are configured to enclose the gift in the convention of gift wrapping;

wherein each of said plurality of first couplers and each of said plurality of second couplers is a zip fastener wherein each of said plurality of second couplers is matable to said respective one of said plurality of first couplers while said plurality of second couplers and said plurality of first couplers are inhibited from adhering directly to the gift;

a plurality of third couplers, each of said plurality of third couplers being attached to said panel, each of said plurality of third couplers being positioned on said top portion of said panel, respective ones of said plurality of third couplers being positioned adjacent to a respective one of an innermost first perforation of said set of first perforations and an innermost second perforation of said set of second perforations;

a plurality of fourth couplers, each of said plurality of fourth couplers being attached to said panel, each of said plurality of fourth couplers being positioned on said bottom portion of said panel, respective ones of said plurality of fourth couplers being positioned adjacent to a respective one of the innermost first perforation of said set of first perforations and the innermost second perforation of said set of second perforations, each of said plurality of fourth couplers being matable to a respective one of said plurality to third couplers wherein said plurality of third couplers and said plurality of fourth couplers are configured to enclose the gift in the convention of gift wrapping; and said innermost first perforation of said set of first perforations being spaced from said innermost second perforation of said set of second perforations by a distance exceeding the width of the gift wherein said respective ones of said plurality of third couplers and said respective ones of said plurality of fourth couplers are spaced from the lower surface and the upper surface of the gift while the gift is enclosed within the panel.

2. The device according to claim 1, wherein:

said panel has a front edge and a back edge;

each of said curves extends between said first lateral edge and said second lateral edge;

each of said curves is positioned on opposite sides of a centerline of said panel such that said spine portion is defined between said pair of curves;

said bottom portion is associated with said back edge;

said top portion is associated with said front edge; and said plurality of perforations is oriented to extend between said front edge and said back edge of said panel.

3. The device according to claim 2, wherein:

said set of first perforations are evenly spaced apart from each other;

said set of second perforations are evenly spaced apart from each other.

4. The device according to claim 3, wherein:

each of said plurality of first couplers is oriented to extend along a line extending between said front edge and said back edge of said panel; and each of said plurality of first couplers is positioned on a respective one of said plurality of first strips or a respective one of said plurality of second strips.

5. The device according to claim 4, wherein:

each of said plurality of second couplers is oriented to extend along a line extending between said front edge and said back edge of said panel;

each of said plurality of second couplers is positioned on a respective one of said plurality of first strips or a respective one of said plurality of second strips;

each of said plurality of second couplers is aligned with a respective one of said plurality of first couplers; and each of said plurality of second couplers which remain on said panel when said respective one of said plurality of first strips or second strips are removed from said panel being matable to said respective plurality of first couplers which remains on said panel when said respective one of said plurality of first strips or second strips are removed from said panel wherein said plurality of first couplers and said plurality of second couplers are configured to enclose the gift in the convention of gift wrapping.

6. The device according to claim 3, wherein:

a respective one of said plurality of third couplers is positioned adjacent to said front edge of said panel; and a respective one of said plurality of fourth couplers being positioned adjacent to said back edge, each of said plurality of fourth couplers being aligned with a respective one of said plurality of third couplers, each of said plurality of fourth couplers being matable to said respective third coupler when all of said first strips and all of said second strips have been removed from said panel wherein said plurality of third couplers and said plurality of fourth couplers are configured to enclose the gift in the convention of gift wrapping.

7. The sealable gift wrapping device of claim 1, wherein said respective ones of said plurality of fourth couplers are spaced from said respective one of said innermost first perforation of said set of first perforations and said innermost second perforation of said set of second perforations.

8. The sealable gift wrapping device of claim 1, wherein each of said plurality of third couplers and each of said plurality of fourth couplers is a zip fastener wherein each of said plurality of third couplers is matable to said respective one of said plurality of fourth couplers while said plurality of third couplers and said plurality of fourth couplers are inhibited from adhering directly to the gift.

* * * * *